US007640702B2

(12) United States Patent
Termohlen

(10) Patent No.: US 7,640,702 B2
(45) Date of Patent: Jan. 5, 2010

(54) FLOOR SUPPORT SYSTEMS AND METHODS

(75) Inventor: David E. Termohlen, Las Vegas, NV (US)

(73) Assignee: Thornton-Termohlen Group Corporation, Las Vegas, NV (US)

( * ) Notice: Subject to any disclaimer, the term of this patent is extended or adjusted under 35 U.S.C. 154(b) by 197 days.

(21) Appl. No.: 11/757,899

(22) Filed: Jun. 4, 2007

(65) Prior Publication Data

US 2008/0295427 A1 Dec. 4, 2008

(51) Int. Cl.
*E04C 2/52* (2006.01)
*E04H 1/00* (2006.01)
*E04B 1/00* (2006.01)

(52) U.S. Cl. ..... 52/280; 52/261; 52/264; 52/220.3; 52/236.6

(58) Field of Classification Search ..... 52/280, 52/272, 275, 277, 281, 220.3, 220.2, 236.6, 52/236.8, 236.9, 261, 264
See application file for complete search history.

(56) References Cited

U.S. PATENT DOCUMENTS 2,970,676 A * 2/1961 Maciunas ..... 52/207
3,365,225 A * 1/1968 Ehinger ..... 403/217
3,396,502 A 8/1968 Contevita
3,686,816 A 8/1972 Erbil
3,729,878 A 5/1973 Termohlen et al.
3,732,655 A 5/1973 Termohlen et al.
3,822,522 A 7/1974 Termohlen et al.
3,981,109 A 9/1976 Termohlen
4,125,973 A * 11/1978 Lendrihas ..... 249/188
4,126,364 A * 11/1978 Reilly ..... 312/140
4,230,052 A * 10/1980 Champagne ..... 108/147.14
4,348,129 A * 9/1982 Conforti ..... 403/218
4,398,841 A * 8/1983 Kojima et al. ..... 403/173
4,885,883 A * 12/1989 Wright ..... 52/280
4,903,452 A * 2/1990 Huang ..... 52/646
5,289,665 A * 3/1994 Higgins ..... 52/655.1
5,372,448 A * 12/1994 Gilb ..... 403/231
5,440,844 A * 8/1995 Chihara et al. ..... 52/280
5,653,077 A * 8/1997 Carnicello et al. ..... 52/646
5,941,044 A * 8/1999 Sera ..... 52/655.1
5,967,262 A * 10/1999 Krause ..... 182/222
6,946,599 B2 * 9/2005 VanderVelde ..... 174/500

* cited by examiner

*Primary Examiner*—Richard E Chilcot, Jr.
*Assistant Examiner*—Mark R Wendell
(74) *Attorney, Agent, or Firm*—Townsend, Townsend & Crew LLP

(57) ABSTRACT

According to the invention, a system for supporting a floor structure from a central structure is disclosed. The system may include a plurality of receptacles and a plurality of support members. Each of the receptacles may be located within a corner of an exterior perimeter of the central structure. Each of the receptacles may also at least partially define a cavity which may open to two different sides of the central structure. Each of the support members may be configured to pass through the cavity of at least one of the receptacles. Furthermore, each of the support members may be configured to be supported by at least one of the receptacles, and extend outward from two different sides of the central structure. The support members may further be configured to support the floor structure on two different sides of the central structure.

20 Claims, 7 Drawing Sheets

FLOOR SUPPORT SYSTEMS AND METHODS

BACKGROUND OF THE INVENTION

This invention relates generally to building construction. More specifically the invention relates to systems and methods of supporting floors and roofs of buildings.

In some methods of constructing buildings, floors and roofs may be created and/or located in their final position after construction of a central structure. These floors and roofs must be supported in some manner so as to provide stability for activity to occur on the floor or roof during and after construction. Typical construction methods, especially for high-rise buildings, support each floor from the ground upwards.

Often a great number of vertical structural members, columns for example, provide such support, and extend throughout the height of the building. The weight of these vertical structural members must be supported by the vertical structural members below them, compounding design factors at lower levels of the building. Additionally, valuable floor space on each floor may be lost, or at least become unusable, because of the protrusion of each vertical structural member. Embodiments of the present invention provide solutions to this and other problems.

BRIEF DESCRIPTION OF THE INVENTION

In one embodiment, a system for supporting a floor structure from a central structure is provided. The system may include a plurality of receptacles and a plurality of support members. Each of the plurality of receptacles may be located within the central structure and possibly located at a corner of an exterior perimeter of the central structure. Each of the plurality of receptacles may also at least partially define a cavity, where the cavity opens to two different sides of the central structure. Each of the plurality of support members may be configured to pass through the cavity of at least one of the plurality of receptacles. Each of the plurality of support members may be further configured to be supported by at least one of the plurality of receptacles, and possibly extend outward from two different sides of the central structure. Each of the plurality of support members may be further configured to support the floor structure on two different sides of the central structure.

In another embodiment, a method for supporting a floor structure from a central structure is provided. The method may include providing a plurality of receptacles within the central structure, where each of the plurality of receptacles at least partially defines a cavity. Each cavity may open to two different sides of the central structure. The method may also include moving the floor structure to an elevation above the plurality of receptacles. The method may further include providing a plurality of support members and supporting the plurality of support members with the plurality of receptacles, where each of the support members may pass through the cavity of at least one of the plurality of receptacles. The method may moreover include supporting the floor structure with the plurality of support members, where each support member may support the floor structure on two different sides of the central structure.

In another embodiment, a system for supporting a floor structure from a central structure is provided. The system may include a first means for supporting a support member from the central structure such that the support member extends outward from two different sides of the central structure. The system may also include a support member, where the support member is configured to support the floor structure on two different sides of the central structure.

BRIEF DESCRIPTION OF THE DRAWINGS

The present invention is described in conjunction with the appended figures.

Figure 1:
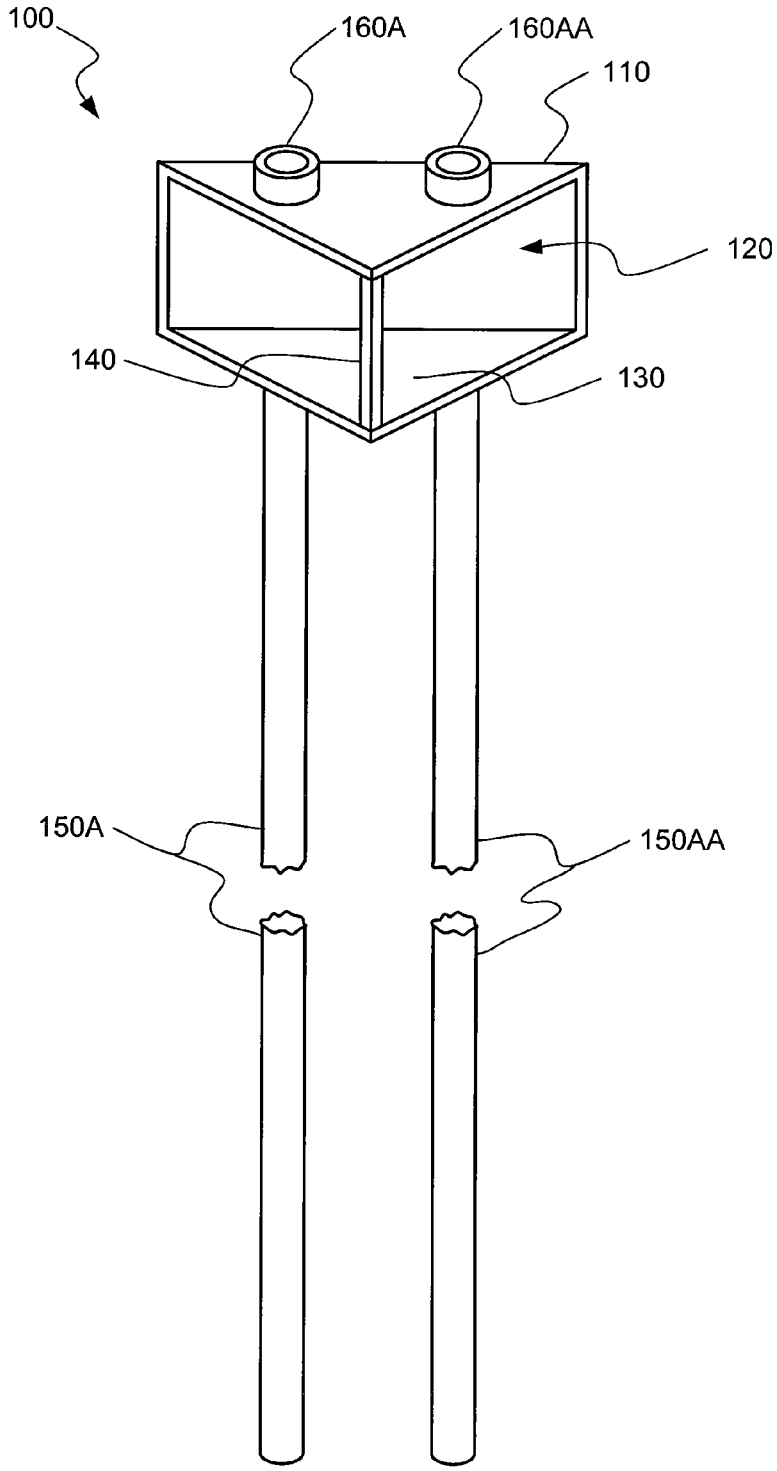
FIG. 1 is an axonometric view of a receptacle of the invention.

In the appended figures, similar components and/or features may have the same numerical reference label. Further, various components of the same type may be distinguished by following the reference label by one or more letters which distinguishes among the similar components and/or features. If only the first numerical reference label is used in the specification, the description is applicable to any one of the similar components and/or features having the same first numerical reference label irrespective of the lettered suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, systems, structures, and other components may be shown as components in block diagram form in order not to obscure the embodiments in unnecessary detail. In other instances, well-known processes, procedures and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not included in a figure. A process may correspond to a method, a process, a procedure, a technique, etc. Furthermore, embodiments may be implemented by manual techniques, automatic techniques, or any combination thereof.

In one embodiment, a system for supporting a floor structure from a central structure is provided. The floor structure and the central structure may be of any construction. In an exemplary embodiment, the floor structure may be constructed of structural steel members and concrete, and the central structure may be a building core constructed of rebar reinforced concrete, poured and formed in place. Though in many embodiments the central structure may be polygonal in cross section, in some embodiments the central structure may have a perimeter that is for some portion curved, or even entirely curved. In curved embodiments, different "sides" of the central structure may be assumed to include any appreciably different angular location about the curved surface of the central structure.

In some embodiments, the central structure and/or the floor structure may be part of a larger building. Some possible buildings in which systems and methods of the invention may be employed are described in U.S. patent application Ser. No. 11/746,834, filed May 10, 2007 and entitled "Multi-Story Building," the entire contents of which are hereby incorporated by reference for all purposes. Though floor structures are discussed throughout this description, it will become appreciable that the systems and methods of the invention may also be employed to support roof structures from central structures as well.

In some embodiments, the system may include a plurality of receptacles and a plurality of support members. In some embodiments, each of the plurality of receptacles may be located within the central structure and possibly at a corner of an exterior perimeter of the central structure. In these or other embodiments, each of the plurality of receptacles may also at least partially define a cavity, and the cavity may open to two different sides of the central structure. In some embodiments, one or more receptacles may include a buttressing member configured to at least assist in maintaining the shape of the cavity. In some of these embodiments, the buttressing member may be at least generally aligned with a vertical edged corner of the central structure.

In some embodiments, each of the plurality of support members may be configured to pass through the cavity of at least one of the plurality of receptacles. In these or other embodiments, the support members may also be configured to be supported by at least one of the plurality of receptacles, and possibly extend outward from two different sides of the central structure. In some embodiments, each of the plurality of support members may also be configured to support the floor structure on two different sides of the central structure.

In some embodiments, the floor structure surround at least some portion of the central structure and may be configured to move up and/or down some portion of the height of the central structure. In these or other embodiments, the support members may be movably coupled with the underside of the floor structure. As such, the support members may initially be in a first position which allows the floor structure to move up and/or down the central structure without interference by the support member.

When the floor structure is finally located at a desired elevation, the support members may be moved from the first position to a second position where each support member passes through a cavity of a receptacle, possibly extending outward from two different sides of the central structure. The floor may then be lowered slightly such that the support members are supported by the receptacle and the floor structure is supported by the support members. Therefore, in some embodiments, the support member may support the floor structure on two different sides of the central structure. Note that in some embodiments, the floor may be supported as such from more than one central structure.

In some embodiments, the system for supporting the floor structure from a central structure may also include a means for moving a support member between the first position to the second position described above. In some embodiments, the means for moving the support member may be actuated from a topside of the supported floor structure. Such means may be installed at any point during construction, and possibly when the floor is at an elevation in proximity to the working ground level of the building site.

In one embodiment having a means for moving the support member, the means may include the support member being slidably coupled with the underside of the floor structure. A reversibly coupled vertical extension may be coupled to the support member in proximity to the end of the support member furthest from the central structure. A slotted breach in the floor structure may allow the vertical extension to penetrate the floor structure and protrude from the topside of the floor structure.

This vertical extension may be used by a person or automated device on the topside of the floor structure to move the support member between the first position and the second position. The vertical extension's maximum travel may be determined by the length of the slotted breach, which may therefore assist in determining how far the support member may be moved. Once in the second position, the vertical extension may be decoupled (possibly via a threaded coupling), and the slotted breach may be filled to make the topside of the floor structure continuous.

In another embodiment having a means for moving the support member, the means may also include the support member being slidably coupled with the underside of the floor structure. A flexible member, such a cabling or rope, may be coupled with the support member in proximity to the end of the support member furthest from the central structure. A breach in the floor structure may allow the flexible member to penetrate the floor structure and protrude from the topside of the floor structure.

The flexible member may be pulled by a person or automated device on the topside of the floor structure to move the support member from the first position to the second position. In some embodiments, a pulley or other pivot point may assist in directing the force of pulling on the flexible member to more appropriately align with the location of the cavity with respect to the support member. The flexible member may also have a stop-member coupled with the flexible member in a location which assists in determining how far the flexible member may be pulled through the breach, and hence how far the support member may be moved.

Once in the second position, the flexible member may be pushed back through the breach, cut, or otherwise removed, and the breach may be filled to make the topside of the floor structure continuous. In yet other embodiments, the support member may be spring loaded, or compressed gas and/or magnets may be used to move the support member into position remotely from the topside of the floor structure.

In some embodiments, one or more receptacles may include at least one vertical member, possible coupled with the top and/or bottom of the receptacle. In an exemplary embodiment, two vertical members may be included with each receptacle. Vertical members may, in some embodiments, at least assist in locating the receptacle in vertical relation to the ground or another receptacle. Additionally, vertical members may assist in transferring load from thee receptacle to the central structure in which the receptacle may be encased or coupled to. In one embodiment, the length of the vertical member may be related to the height of the floor-to-ceiling space below or above the receptacle. In some embodiments, where the central structure is made from a poured in place hardenable substance, such as concrete, the vertical members may be coupled with a collar coupled with either the ground, or another receptacle, before or during pouring to ensure proper elevation locating of the receptacle. In some embodiments, each receptacle positioned to assist in supporting a particular floor may have a vertical element of the same length as others supporting the particular floor.

In some embodiments, the vertical members of the receptacles, or any other portion of the receptacle, may be coupled with reinforcement members within the central structure. Merely by way of example, in embodiments where the central structure is rebar reinforced poured in place concrete, rebar within the concrete may be coupled with the vertical members of the receptacles.

In other embodiments, methods for supporting a floor structure from a central structure are provided, some of which may utilize the one or more of the systems described above. The method may include providing a plurality of receptacles within the central structure. In embodiments where the central structure is poured from a hardenable substance, the method may possibly include inserting the receptacles into the central structure during pouring of the hardenable substance. In some embodiments, and as discussed above, the receptacles may also be coupled with reinforcement members in the central structure. As described above, the receptacles may also include attached, or separate, vertical members which may at least assist in locating the receptacles vertically with respect to other receptacles or the ground.

The method may further include moving the floor structure to an elevation at or above the plurality of receptacles. The method may then include providing a plurality of support members and supporting the plurality of support members with the plurality of receptacles, and then supporting the floor structure with the plurality of support members, where each support member may support the floor structure on two different sides of the central structure. The floor structure may be lowered some distance so that the weight of the floor structure causes the support members to be supported by the receptacles, and the floor structure by the support members.

In some embodiments, the method may also include activating means for moving support members from their first or initial positions, underneath the floor structure, to their final or second positions, supported by the receptacles. In some embodiments, systems mentioned above may be activated, either from the topside of the floor structure or otherwise, to cause the support members to be moved.

FIG. 1 is an axonometric view of a receptacle 100 of the invention. Receptacle 100 may include a body 110 which defines a cavity 120. The cavity may have a support surface 130 which will allow a support member (not shown) to be supported by receptacle 100. A buttressing member 140 may at least assist in maintaining the shape of cavity 120 when receptacle 100 is put under either dynamic or static loading. Receptacle 100 may also include vertical members 150A, 150AA. Vertical members 150 may mate with collars on another receptacle or at ground level, possibly similar to collars 160A, 160AA shown on receptacle 100.

Figure 2:
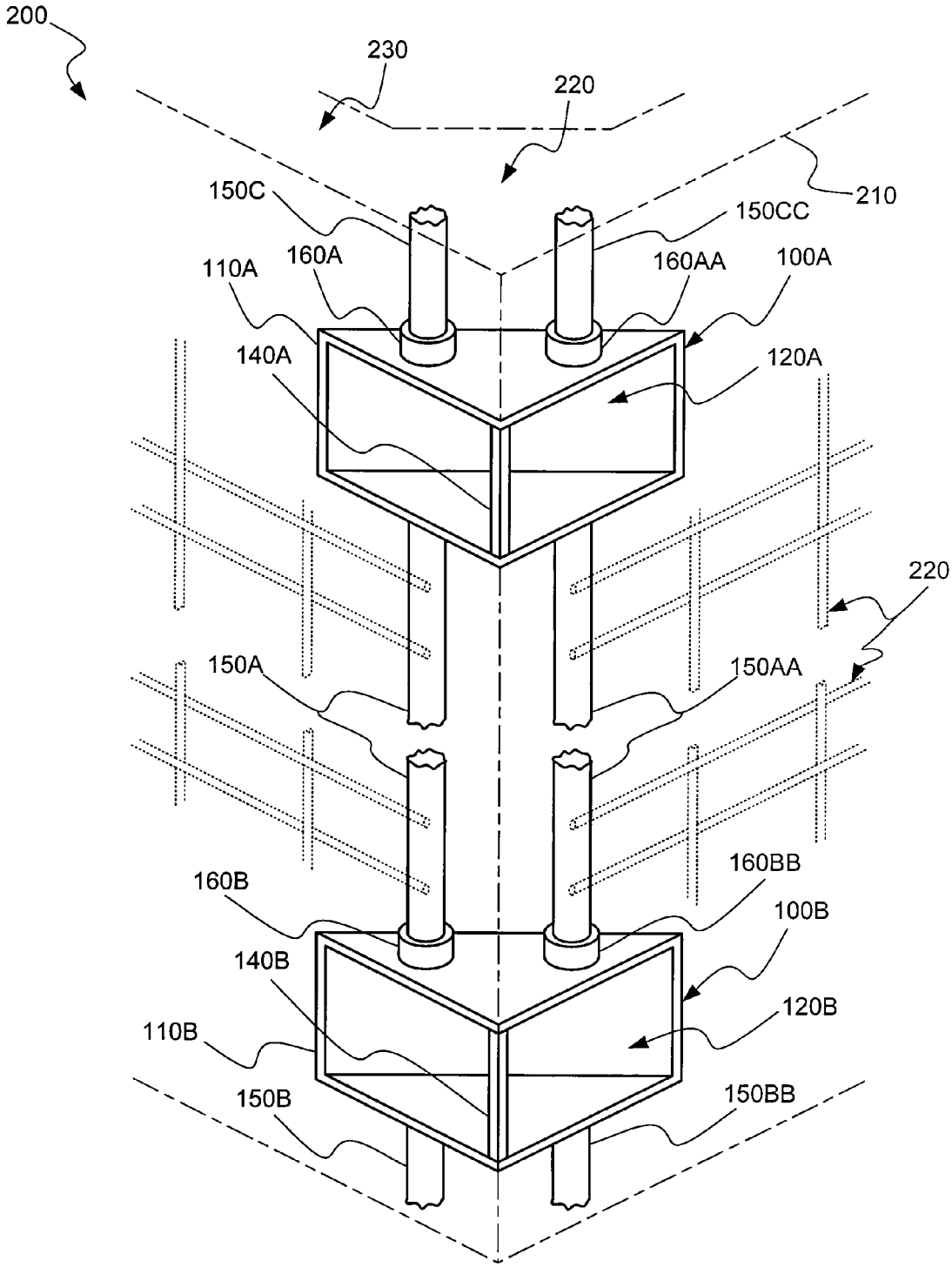
FIG. 2 is an axonometric view of two receptacles of the invention embedded in a central structure.

FIG. 2 is an axonometric view 200 of two receptacles 100A, 100B of the invention embedded in a portion of a central structure 210. In this embodiment, cavities 120A, 120B of each receptacle 100A, 100B open to different, and adjacent, sides of structure 210. In this embodiment, rebar 220 is shown coupled with the vertical member 150A (shown broken because of the large distance between receptacles 100A, 100B). Multiple numbers and type of rebar 220 or other reinforcement members may be coupled with vertical members 150A, 150AA in any number of fashions, including welding and/or rebar tie wire. Even though not shown in FIG. 2, rebar 220 may also be coupled with other vertical members such as vertical members 150B, 150BB and vertical members 150C, 150CC.

In some embodiments, corners 220 of central structure 210 may be reinforced and/or thicker than walls of central structure 21 0. This may allow for room and proper structural support of receptacles 100.

Vertical members 150A, 150AA of receptacle 100A may mate with collars 160B, 160BB of receptacle 100B during construction of central structure 210 to at least assist in properly locating the receptacles 100, and consequently the final locations of floor structures placed about central structure 210. Note that in some embodiments, vertical members 150 could be configured differently than shown in FIG. 2. In some embodiments, vertical members 150 may be separate from bodies 110, while in other embodiments, vertical members 150 may be coupled with the top of bodies 110, rather than the bottom of bodies 110 as shown in FIG. 2.

Also shown in FIG. 2 are buttressing members 140. Buttressing members 140 may at least assist in cavities 120 maintaining their shape under the static and dynamic loading during and after construction of central structure. By maintaining the shape of cavities 120, it is more likely that support members will be able to be inserted into receptacles 100. Buttressing members 140 may have any shape, and merely by way of example may have square, triangular, polygonal, or round cross sections.

Figure 3:
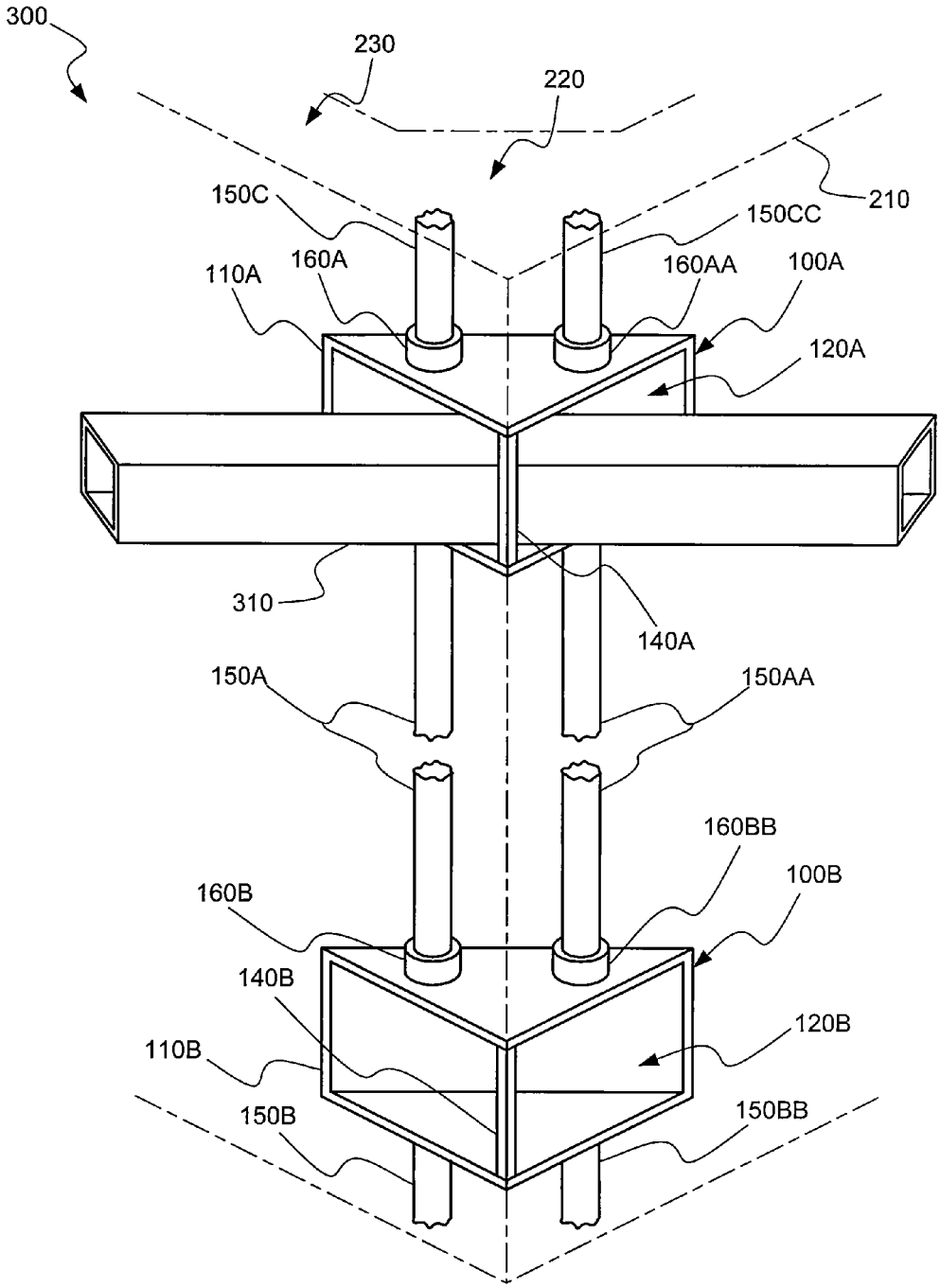
FIG. 3 is an axonometric view of a support member supported by one of the receptacles in FIG. 2.

FIG. 3 is an axonometric view 300 of a support member 310 supported by receptacle 100A as previously shown in FIG. 2. As shown, support member 310 has been inserted into cavity 120A. Though support member 310 is shown as tubular, it may take any shape, and may in some embodiments be structural shapes such as I-beams.

Figure 4:
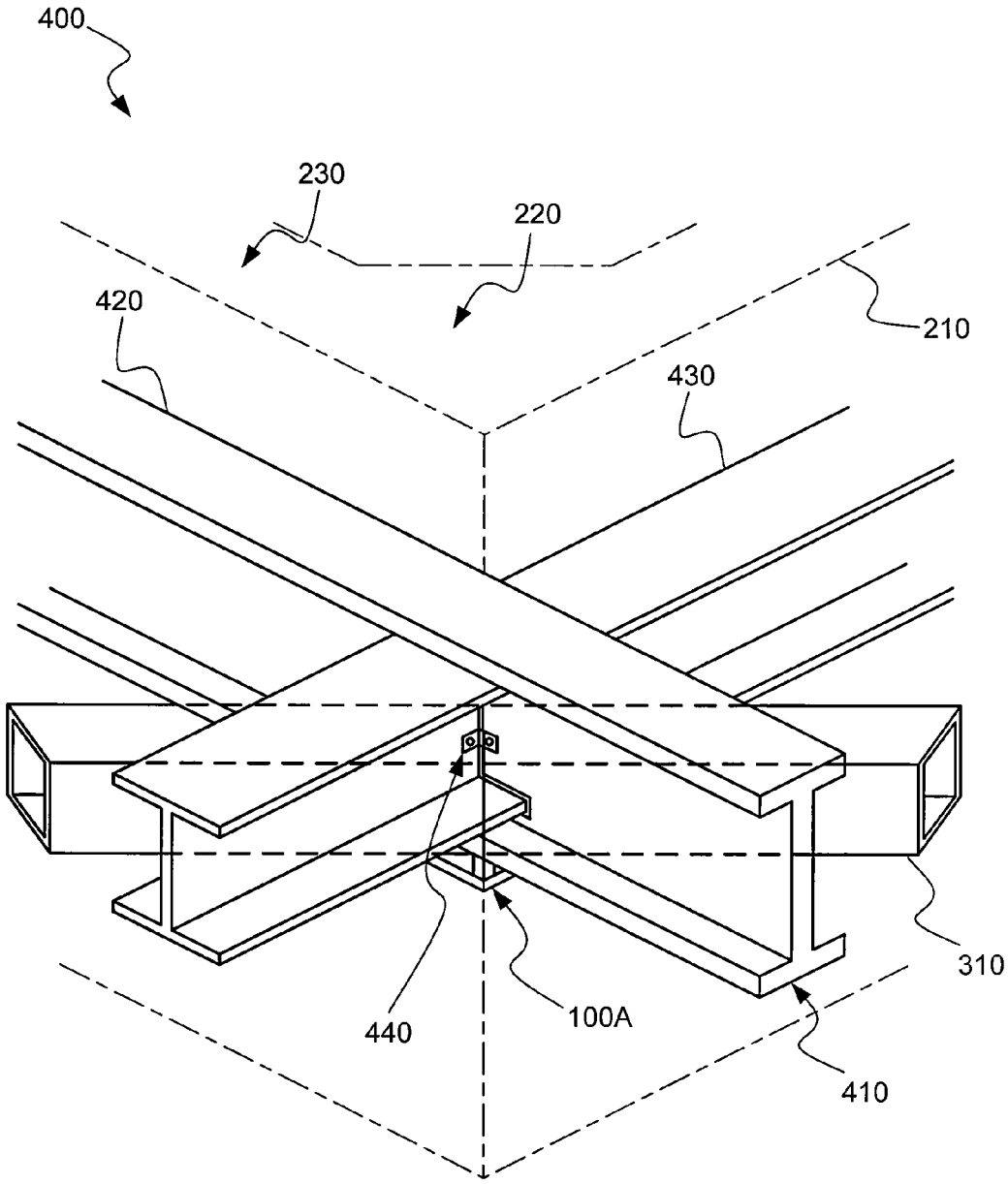
FIG. 4 is an axonometric view of a portion of a floor structure supported by the support member in FIG. 3.

FIG. 4 is an axonometric view 400 of a portion of a floor structure 410 supported by support member 3 10. Floor structure 410 may include a primary structural member 420 and a secondary structural member 430. Primary structural member 420 and secondary structural member 430 may be coupled at joint 440. Once located in their final, resting positions, support member 310 may be supported by receptacle 100A, and floor structure 410 may be supported by support member 310.

If central structure 210 is square or rectangular in shape, the system shown in FIG. 4, or other embodiments of the invention, may be placed at one or more other corners of central structure to at least assist in supporting floor structure 410. In some embodiments, multiple central structures 210 may be used, possibly with one or more corners of each central structure 210 employing systems of the invention to support a floor structure 410.

Because secondary structural member 430 is shorter in height than primary structural member 420, a spacer element may be placed between support member 310 and secondary structural member 430 (not shown in FIG. 4). This may allow support member 310 to support secondary structural member 430 as well as primary structural member 420 regardless of a height difference between the two structural members 420, 430.

Figure 5:
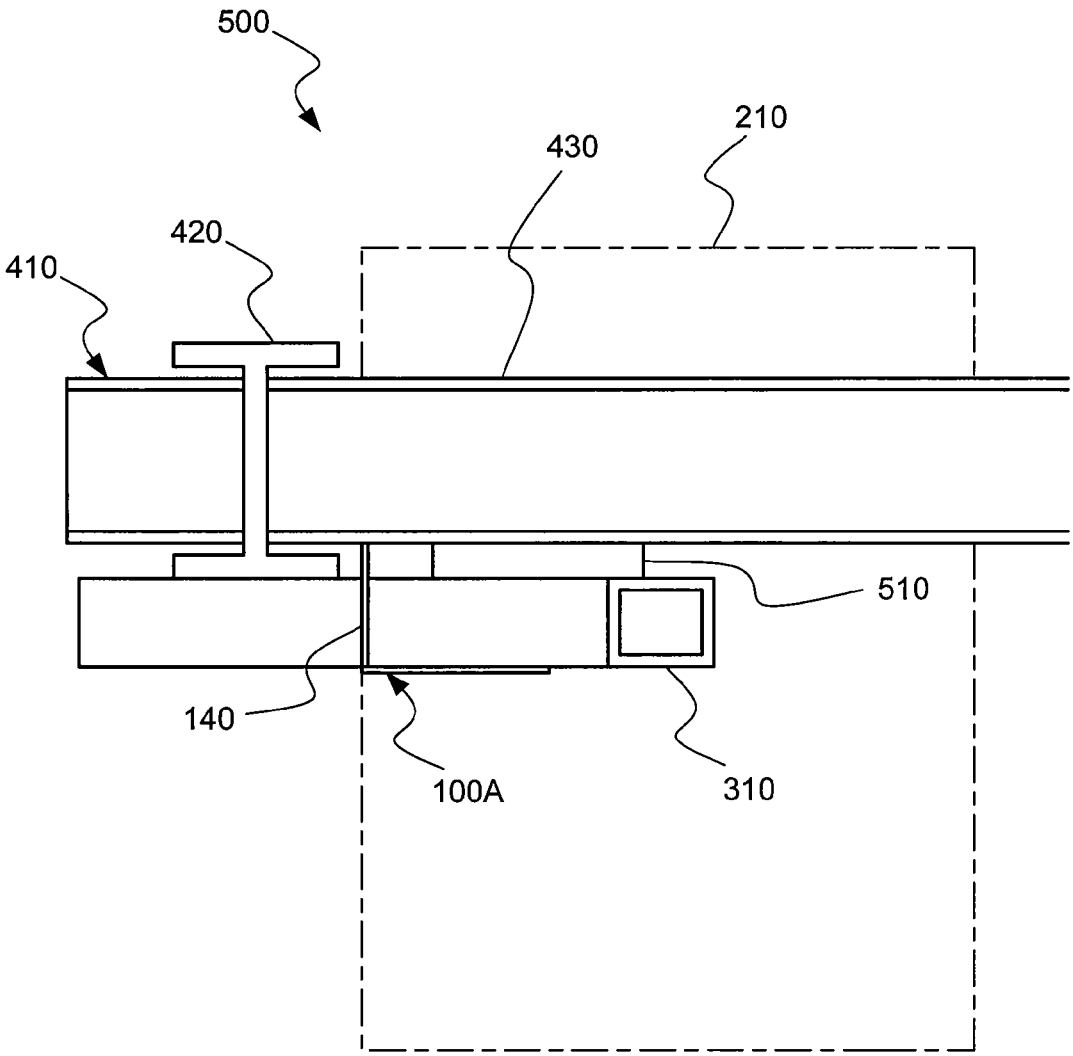
FIG. 5 is a side view of FIG. 4 showing a spacer element between the floor structure and the support member.

FIG. 5 is a side view 500 of FIG. 4 showing a spacer element 510 between secondary structural member 430 and support member 310. In some embodiments, spacer element 510 may be pre-coupled with support member 310. In other embodiments, space element may be pre-coupled with secondary structural member 430.

In some embodiments, spacer element 510 may include two components, one coupled with secondary structural member 430, and one coupled with support member 310. In these embodiments, each component of spacer element 510 may be wedge shaped or otherwise mate-able so that in a final position further movement of support member in relation to floor structure 410 is prohibited once in a final position. In other embodiments, the bottom of floor structure may be planar about the area to be supported by support member 310, and no spacer element 510 may be included in the system.

Figure 6:
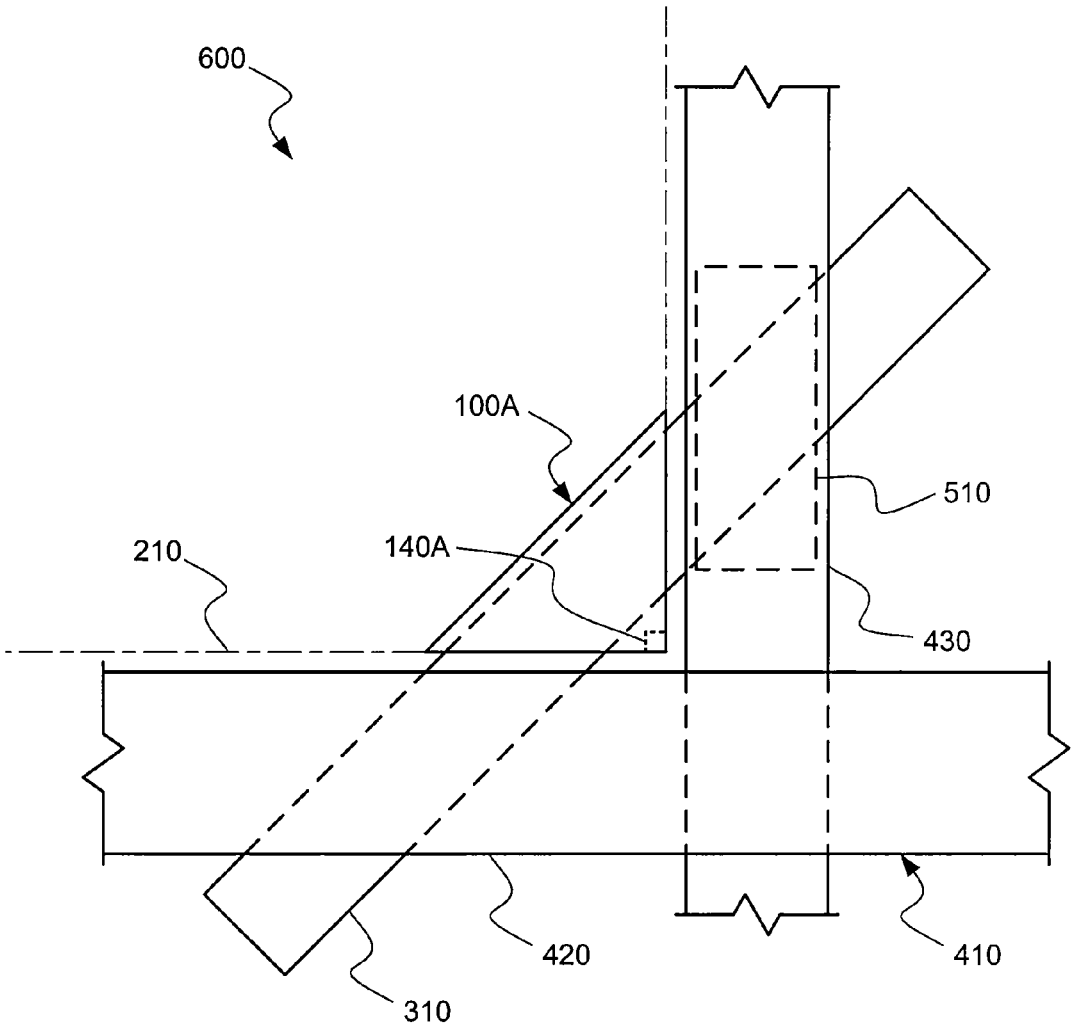
FIG. 6 is a plan view of FIG. 4.
Figure 7:
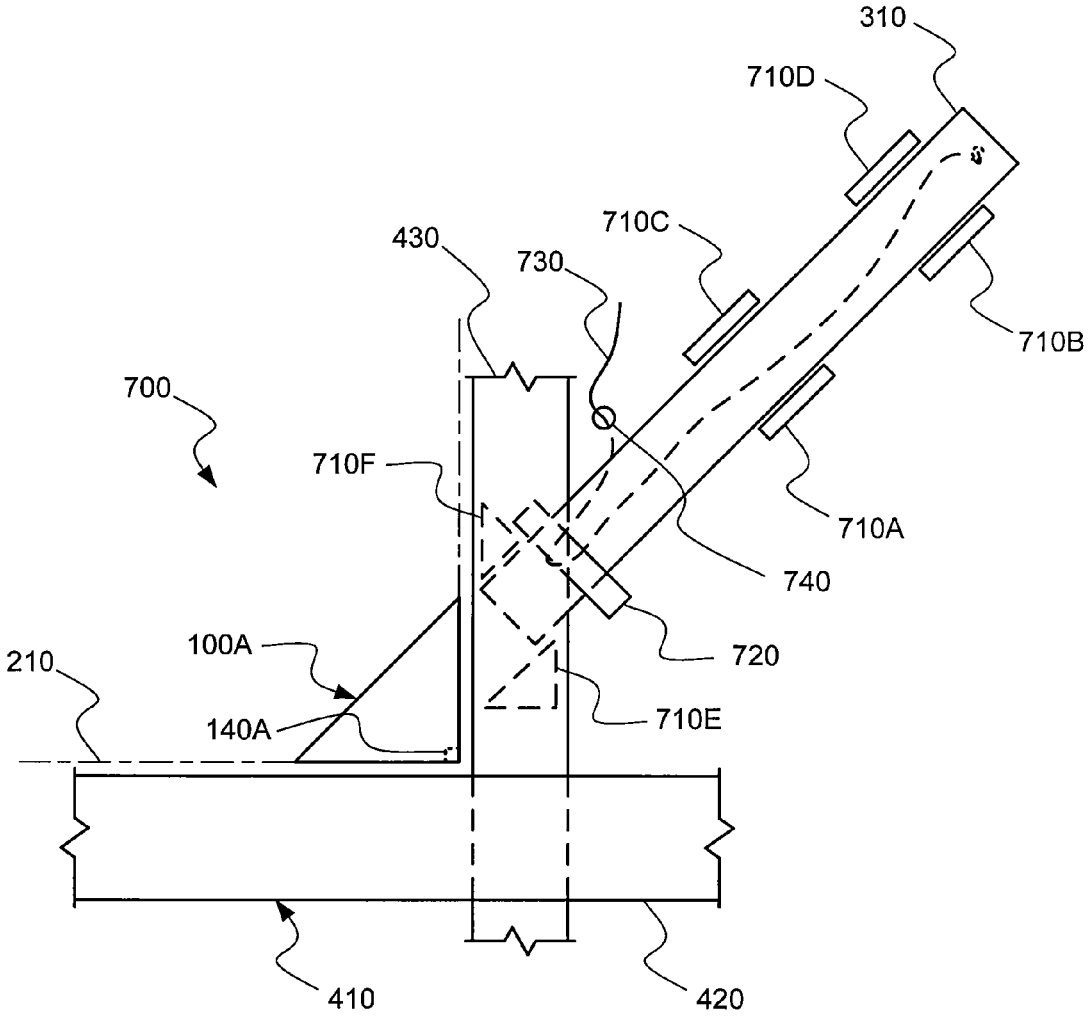
FIG. 7 is a plan view of a system of the invention for moving the support member into place from a topside of the floor structure.

FIG. 6 is a plan view 600 of FIG. 4 and FIG. 5. FIG. 7 is a plan view of a system 700 of the invention for moving support member 310 into place from a topside of floor structure 410. System 700 includes guide members 710, pull axle or pulley 720, and flexible member 730. System 700 may be coupled with the underside of floor structure 410. At least some of guide members 710 may include brackets to movably couple support member 310 to floor structure 410. A breach 740 in floor structure 410 may allow flexible member 730 to pass through floor structure 410 so a person or mechanism may operate system 700.

Once floor structure 410 is at least near in its final elevation, a person or mechanism on top of floor structure 410 may pull flexible member 730. Flexible member 730, being coupled with support member 310, may pull support member 310 about pull axle or pulley 720 toward and into receptacle 100A. Guided by guide members 710, support member 310 may therefore be pulled into position from above the floor structure 410.

The invention has now been described in detail for the purposes of clarity and understanding. However, it will be appreciated that certain changes and to the exemplary embodiments discussed herein may be practiced within the scope of the appended claims.

What is claimed is:

1. A system for supporting a floor structure from a building core, wherein the system comprises:

a plurality of receptacles, wherein:

each of the plurality of receptacles are located within the building core;

each of the plurality of receptacles are located at a corner of an exterior perimeter of the building core; and each of the plurality of receptacles at least partially defines a cavity, wherein the cavity opens to two different sides of the building core; and a plurality of support members, wherein:

each of the plurality of support members is configured to pass through the cavity of at least one of the plurality of receptacles;

each of the plurality of support members is further configured to be supported by at least one of the plurality of receptacles;

each of the plurality of support members is further configured to extend outward from two different sides of the building core; and each of the plurality of support members is further configured to support the floor structure on two different sides of the building core.

2. The system for supporting a floor structure from a building core of claim 1, wherein:

the plurality of receptacles includes a first receptacle;

the plurality of support members includes a first support member;

the first support member is movably coupled with an underside of the floor structure; and the first support member is configured to be moved between a first position and a second position, wherein in the second position:

the first support member passes through the cavity of the first receptacle;

the first support member is supported by the first receptacle;

the first support member extends outward from two different sides of the building core; and the first support member supports the floor structure on two different sides of the building core.

3. The system for supporting a floor structure from a building core of claim 2, wherein the system further comprises a means for moving the first support member between the first position to the second position.

4. The system for supporting a floor structure from a building core of claim 3, wherein the means is actuated from a topside of the floor structure.

5. The system for supporting a floor structure from a building core of claim 1, wherein each of the plurality of receptacles comprises a vertical member, wherein the vertical member is configured to be coupled with a first other receptacle, wherein the first other receptacle is located at a first different elevation in the building core.

6. The system for supporting a floor structure from a building core of claim 5, wherein each of the plurality of receptacles comprises a collar configured to accept the vertical member of a second other receptacle, wherein the second other receptacle is located at a second different elevation in the building core.

7. The system for supporting a floor structure from a building core of claim 5, wherein the vertical members is coupled with reinforcement members within the building core.

8. The system for supporting a floor structure from a building core of claim 1, wherein each of the plurality of receptacles includes a buttressing member configured to at least assist in maintaining a shape of the cavity.

9. A building having the system for supporting a floor from a building core of claim 1.

10. A method for supporting a floor structure from a building core, wherein the method comprises:

providing a plurality of receptacles within the building core, wherein each of the plurality of receptacles at least partially defines a cavity, wherein the cavity opens to two different sides of the building core;

moving the floor structure to an elevation above the plurality of receptacles;

providing a plurality of support members;

supporting the plurality of support members with the plurality of receptacles, wherein each of the support members passes through the cavity of at least one of the plurality of receptacles; and supporting the floor structure with the plurality of support members, wherein each support member supports the floor structure on two different sides of the building core.

11. The method for supporting a floor structure from a building core of claim 10, wherein:

providing the plurality of support members comprises providing the plurality of support members movably coupled with an underside of the floor structure; and supporting the plurality of support members with the plurality of Receptacles comprises moving the plurality of support members from a first position to a second position, wherein in the second position each of the plurality of support members pass through the cavity of at least one of the plurality of receptacles.

12. The method for supporting a floor structure from a building core of claim 10, wherein the method further comprises coupling at least one of the plurality of receptacles with a first other receptacle, wherein the first other receptacle is located at a first different elevation in the building core.

13. The method for supporting a floor structure from a building core of claim 12, wherein the method further comprises coupling at least one of the plurality of receptacles with a second other receptacle, wherein the second other receptacle is located at a second different elevation in the building core.

14. The method for supporting a floor structure from a building core of claim 10, wherein the method further comprises coupling the receptacles with reinforcement members within the building core.

15. A building having at least one floor structure supported by the method of claim 10.

16. A system for supporting a floor structure from a building core wherein the system comprises:

a first means for supporting a support member from the building core such that the support member extends outward from two different sides of the building core; and a support member, wherein the support member is configured to support the floor structure on two different sides of the building core.

17. The system for supporting a floor structure from a building core of claim 16, wherein the system further comprises a second means for moving the support member from a first position to a second position, wherein in the second position the support member is supported by the first means.

18. The system for supporting a floor structure from a building core of claim 17, wherein the second means is actuated from a topside of the floor structure.

19. The system for supporting a floor structure from a building core of claim 16, wherein the system further comprises a second means for locating the first means at a particular vertical distance from a third means for supporting a support member from the building core such that the support member extends outward from two different sides of the building core.

20. The system for supporting a floor structure from a building core of claim 16, wherein the system further comprises a second means for assisting in maintaining a shape of the first means.

* * * * *

UNITED STATES PATENT AND TRADEMARK OFFICE

CERTIFICATE OF CORRECTION

PATENT NO. : 7,640,702 B2
APPLICATION NO. : 11/757899
DATED : January 5, 2010
INVENTOR(S) : David E. Termohlen It is certified that error appears in the above-identified patent and that said Letters Patent is hereby corrected as shown below:

At column 8, line 58, delete "Receptacles" and insert --receptacles-- therefor.

Signed and Sealed this

Second Day of February, 2010

David J. Kappos

David J. Kappos
*Director of the United States Patent and Trademark Office*